United States Patent [19]

Brzezinski et al.

[11] Patent Number: 4,492,825

[45] Date of Patent: Jan. 8, 1985

[54] ELECTROACOUSTIC TRANSDUCER

[75] Inventors: Alex M. Brzezinski; Harold J. Hershey; Stephen R. Whitesell, all of Indianapolis, Ind.

[73] Assignee: AT&T Bell Laboratories, Murray Hill, N.J.

[21] Appl. No.: 402,613

[22] Filed: Jul. 28, 1982

[51] Int. Cl.[3] ..... H04R 19/01; H04R 19/00; H04R 17/00

[52] U.S. Cl. ..... 179/111 R; 29/25.35; 310/324

[58] Field of Search ..... 179/111 R, 111 E, 110 A, 179/146 R; 29/592 E, 594, 25.35; 307/400; 367/173, 188; 361/397; 310/322, 324

[56] References Cited

U.S. PATENT DOCUMENTS

| | | | |
|---|---|---|---|
| 3,775,572 | 11/1973 | Ishibashi et al. | 179/111 R |
| 3,816,671 | 6/1974 | Fraim et al. | 179 111 E/ |
| 3,946,422 | 3/1976 | Yagi et al. | 179/111 E |
| 3,963,881 | 6/1976 | Fraim et al. | 179/111 E |
| 4,046,974 | 9/1977 | Braumhauer et al. | 179/111 R |
| 4,170,721 | 10/1979 | Ishibashi et al. | 179/111 R |
| 4,188,513 | 2/1980 | Morrell et al. | 179/111 E |
| 4,331,840 | 5/1982 | Murphy et al. | 179/111 E |

FOREIGN PATENT DOCUMENTS 2089170 6/1982 United Kingdom ..... 29/592 E

*Primary Examiner*—Gene Z. Rubinson
*Assistant Examiner*—Danita R. Byrd
*Attorney, Agent, or Firm*—H. L. Newman

[57] ABSTRACT

A transducer embodying the present invention is assembled on a discrete electrically conductive frame (100) that has been formed to provide both leads (120–140) and a backplate (110). An integrated circuit chip (200) is bonded to one of the leads, and a dielectric inner housing member (300) is molded about the backplate and the portion of the leads adjacent to it. The inner housing member encapsulates the chip, embraces the perimeter of the backplate, and provides a cylindrical opening (310) that extends on each side of the backplate. A conductive outer housing member (400) is subsequently molded about the perimeter of the inner housing member, and a spacer (500), electret diaphragm assembly (600), and conductive gasket (700) are sequentially positioned in the opening on one side of the backplate. Conductive front and back covers (800,900) are thereafter bonded to the outer housing to close the opening and to complete a conductive enclosure that provides electrostatic shielding for the transducer. In addition, electrical continuity is provided between a metalized surface on the electret diaphragm and the conductive enclosure by means of the gasket.

27 Claims, 9 Drawing Figures

ELECTROACOUSTIC TRANSDUCER

FIELD OF THE INVENTION

This invention relates to the field of transducers and within that field to electroacoustic and/or electret transducers.

BACKGROUND OF THE INVENTION

Electret electroacoustic transducers commonly comprise a conductive backplate and a permanently charged electret diaphragm that is separated from the backplate by a peripheral spacer. The surface of the electret diaphragm remote to the backplate is metalized, and the metalized surface is engaged by an electrically conductive member that maintains the diaphragm under tension. The electrical signal resulting from an acoustical signal impinging upon the diaphragm is applied to an impedance matching preamplifier circuit, and this circuit is commonly mounted adjacent to the backplate to facilitate electrically connecting the backplate to the circuit. Finally, to provide electrostatic shielding, these components are commonly assembled within an electrically conductive housing that makes electrical connection with the conductive tensioning member and provides a connection to a ground terminal.

While this basic structure is found in a variety of different arrangements, the problem has been that very few of these arrangements permit the use of automated manufacturing, assembly, and testing techniques.

One arrangement that appears to be directed toward this goal is disclosed in U.S. Pat. No. 3,775,572 issued to Ishibashi et al on Nov. 27, 1973. Ishibashi discloses a microphone which uses a group of three leads formed on a continuous strip. An integrated circuit chip is bonded adjacent to the upper end of one of the leads, and then wire connections are made between the circuit on the chip and the leads. This assembly is thereafter encapsulated in a disk-shaped insulating support with the leads extending parallel to the axis of and out the bottom surface of the support. The leads are then severed from the continuous strip, and one of the leads is cut off essentially flush with the bottom surface of the support. This same lead is of a height to extend close to the upper surface of the support, and the upper surface is lapped sufficiently to expose the end surface of this lead. A backplate is then either attached to the upper surface of the support or formed by evaporating metal on the upper surface, the backplate being thereby electrically connected to the lead by engagement with its exposed end surface. A ring-shaped insulating spacer and a diaphragm mounted to the underside of a ring-shaped conductive spacer are thereafter sequentially stacked on the support and the combination assembled within an inverted metal cup. The assembly is completed by stacking a disk-shaped insulating spacer and a conductive shield plate on the underside of the support, and then rolling over the lip of the metal cup against the shield plate to secure the assembly together.

This design was found by its corporate owner to be unsatisfactory in some respects. As stated in the introduction of U.S. Pat. No. 4,170,721, issued to Ishibashi et al, on Oct. 9, 1979, "If the conductive material used for the backplate is not coated on the insulating member uniformly, or if an upper surface of an insulating member is not formed flatly, the distance between the backplate and diaphragm is not uniform throughout." This subassembly must then be discarded.

The solution disclosed in this subsequent patent is a structure in which the backplate is encapsulated in a second insulating support, and the backplate is of a height to extend below the bottom surface of the second support. The lead that is to make electrical contact with the backplate, rather than being flush with the upper surface of the first support, extends above the upper surface, and an additional insulating member, which has an opening for accommodating the lower end of the backplate, is positioned between the first and second supports. Furthermore, a connector is interposed between the lead and the backplate to electrically connect one to the other. Since these components are in addition to the rest of the components of the first structure, it is seen that this solution adds significantly to the complexity of the structure.

SUMMARY OF THE INVENTION

The electroacoustic transducer to the present invention facilitates automated manufacture without introducing the problems presented by the first above-described patent and without the complexity of the structure disclosed in the second above-described patent.

A transducer in accordance with the present invention is assembled on a unitary discrete electrically conductive frame member that is formed to provide both a plurality of leads and a backplate. An amplifier chip is bonded to one of the leads, and a dielectric inner housing member is molded about the backplate and the portion of the leads adjacent to it. The inner housing member encapsulates the chip, embraces the perimeter of the backplate, and provides a cylindrical opening that extends on each side of the backplate. A conductive outer housing member is subsequently molded about the perimeter of the inner housing member, and a spacer, electret diaphragm assembly, and conductive gasket are sequentially positioned in the opening on one side of the backplate. Conductive front and back covers are thereafter bonded to the outer housing member to close the opening, provide acoustically tuned front and back chambers, and complete a conductive enclosure that provides electrostatic shielding for the transducer. In addition, electrical continuity is provided between a metalized surface on the electret diaphragm and the conductive enclosure by means of the gasket.

DETAILED DESCRIPTION

Figure 1:
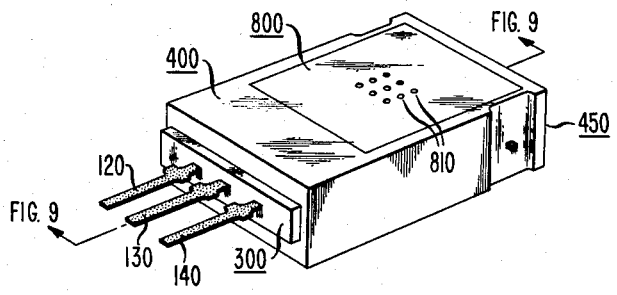
FIG. 1 is a perspective view of an electret electroacoustic transducer embodying the present invention.
Figure 2:
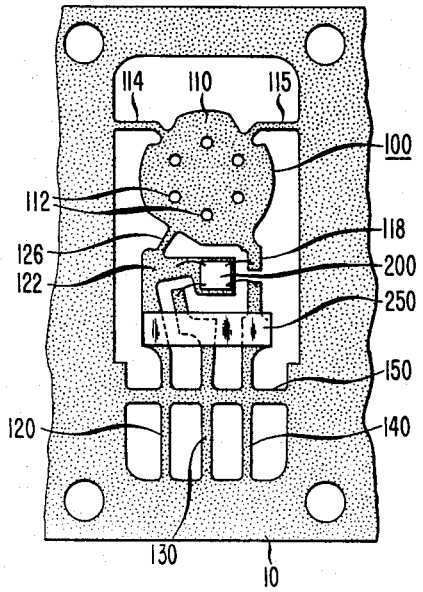
FIG. 2 is a plan view of an electrically conductive strip that has been formed to provide a discrete frame member comprising both leads and a backplate, the leads having electrical components joined to them.

As seen from FIG. 1 of the drawing, one embodiment of an electroacoustic transducer in accordance with the present invention comprises a rectangular box-like structure having leads extending out one end. The basic component of the structure is a unitary frame member 100 shown in FIG. 2. The frame member 100 is advantageously repetitively formed along the length of a continuous strip 10 of electrically conductive material, such as copper. In addition, the frame member 100 is of sufficient thickness to be a discrete, self-supporting member. It does not require an additional element, such as a dielectric substrate to give it support or rigidity.

The frame member 100 includes a backplate 110 and three leads 120, 130 and 140. The backplate 110 has an array of holes 112 in it and is joined to the strip 10 by two connecting links 114 and 115. In addition, the backplate 110 has an outwardly extending leg 118 at its perimeter. The lower ends of the leads 120–140 are joined to the strip 10, while the middle portions of the leads are joined to one another and to the strip by a web 150. The upper end of the lead 120 includes an arm portion 122 that extends adjacent to the upper ends of the leads 130 and 140 and the leg 118 of the backplate 110. The upper end of the lead 120 also includes a connecting link 126 that joins the lead to the backplate 110.

An integrated circuit chip 200, which advantageously embodies the circuit disclosed in the copending patent application of S. H. Early and R. H. Minear, Ser. No. 370,498, filed Apr. 21, 1982, and assigned to the same assignee as the present application, is bonded to the free end of the arm 122 of the lead 120. Circuitry on the chip 200 is electrically connected to the leg 118 of the backplate 110, the arm 122 of the lead 120, and the upper ends of the leads 130 and 140 by individual connecting wires. A chip 250 carrying thin film capacitors is also bonded to and electrically connected to the leads 120–140.

Figure 3:
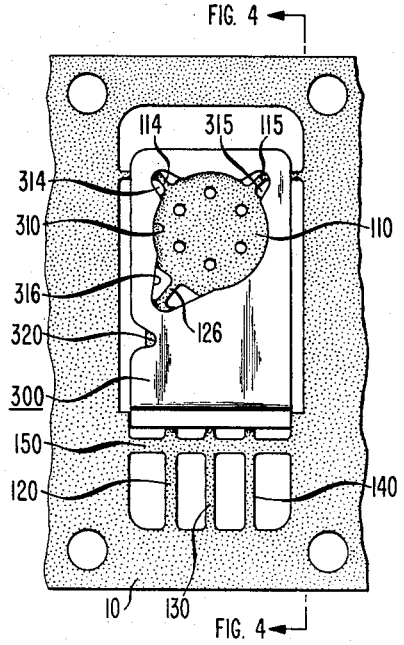
FIG. 3 is a plan view showing the addition of a dielectric inner housing member molded about the perimeter of the backplate and a portion of the leads.
Figure 4:
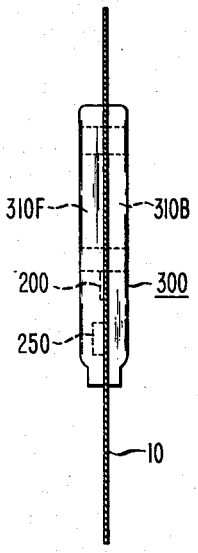
FIG. 4 is a side view taken along line 4—4 of FIG. 3.

Turning now to FIGS. 3 and 4, a dielectric inner housing member 300 is molded about the perimeter of the backplate 110, the inner housing member having an opening 310 that extends on both sides of the backplate. As seen from FIG. 4, the opening 310 is greater in height on one side of the backplate 110 than on the other. The portion of greater height is on the front of the transducer and is designated 310F, while the other portion is on the back of the transducer and is designated 310B.

The opening 310 is basically cylindrical. However, as seen most clearly from FIG. 3, the internal surface defining the opening 310 includes three recesses 314, 315 and 316 aligned with the connecting links 114, 115 and 126 whereby these links are left exposed. Alternatively, the opening 310 can be completely cylindrical and three additional openings provided respectively in alignment with the three connecting links.

The inner housing member 300 is also molded about the portions of the leads 120–140 adjacent to the backplate 110, the inner housing member encapsulating the integrated circuit chip 200, the connecting wires, and the capacitor 250. As seen most clearly in FIG. 3, the web 150 is left exposed. In addition, the left side of the inner housing member 300 has a recess 320 that leaves exposed a portion of the lead 120. The inner housing member 300 is advantageously molded from a semiconductor grade molding compound.

Figure 5:
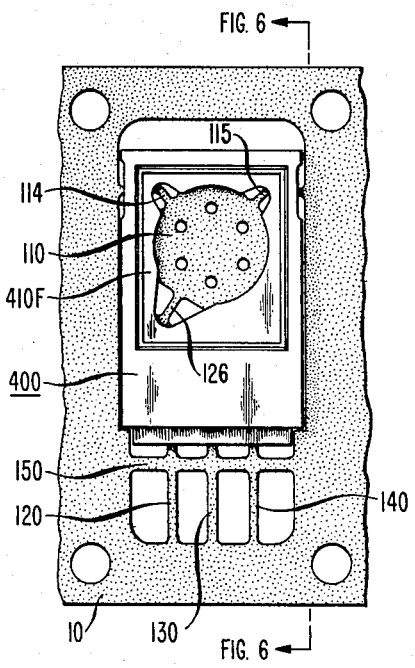
FIG. 5 is a plan view showing the addition of a conductive outer housing member molded about the perimeter of the inner housing member.
Figure 6:
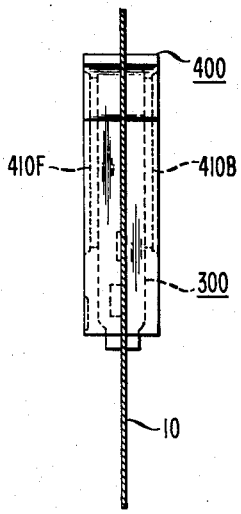
FIG. 6 is a side view taken along line 6—6 of FIG. 5.

Referring now to FIGS. 5 and 6, an electrically conductive outer housing member 400 is molded about the inner housing member 300. The outer housing member 400 includes rectangular openings 410F and 410B that are larger than and in registration with the openings 310F and 310B. Aside from these openings, the outer housing member covers all of the inner housing member surfaces other than the end immediately adjacent to the leads 120–140. Since the outer housing member 400 fills the recess 320 (FIG. 3) in the side of the inner housing member 300, it does engage and is thereby electrically connected directly to the lead 120. The outer housing member 400 is advantageously molded from a conductive grade acrylonitrile butadiene styrene.

Figure 7:
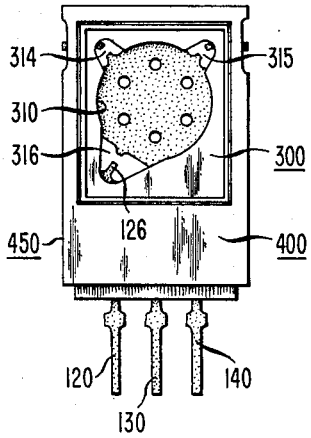
FIG. 7 is a plan view showing the subassembly of FIGS. 5 and 6 severed from the strip and the backplate severed from the leads.

Turning now to FIGS. 5 and 7, with the completion of the molding of the outer housing 400, a subassembly 450 is produced that is fully or partially separable from the strip 10. Full separation is accomplished by severing portions of the connecting links 114 and 115 extending on the outside of the outer housing member 400, severing the lower ends of the leads 120–140, and removing the web 150. The outer housing member 400 is then electrically isolated from the leads 130 and 140. At the same time that the subassembly 450 is separated from the strip 10, the backplate 110 is separated from the rest of the frame member 100. This is accomplished by severing the portions of the connecting links 114, 115 and 126, respectively, within the recesses 314, 315 and 316 of the opening 310 in the inner housing member 300. The backplate 110 is then electrically isolated except for its connection to the circuitry on the chip 200 (FIG. 2) via the associated connecting wire.

The connecting links 114, 115 and 126 when severed are also bent upwardly to increase the electrical isolation of the backplate from these links. The connecting link 126 is also bent in a generally S-shaped curve to provide a contacting surface at its free end that extends generally parallel to the plane of the subassembly 450.

It is more advantageous to only partially separate the subassembly 450 from the strip 10. Referring to FIG. 5, partial separation involves only severing the lower ends of leads 130 and 140 and removing the portions of the web 150 that extend between the lead 120 and the lead 130, between the lead 130 and the lead 140, and between the lead 140 and the strip 10, As with full separation, the backplate 110 is at the same time separated from the rest of the frame member 100 in the manner previously described. The leads 130 and 140 are then electrically isolated except for their connection to the circuitry on the chip 200 (FIG. 2) and the capacitors on the chip 250. The backplate 110 is also electrically isolated except for its connection to the circuitry on the chip 200.

As a result, although the subassembly 450 is still physically supported on the strip 10, the circuitry of the subassembly 450 can be readily tested before any additional components are combined with the subassembly. The testing is accomplished by applying an appropriate signal between the backplate 110 and the lead 120 or strip 10, applying a bias between the lead 140 and the lead 120 or strip 10, and detecting the output on lead 130. It is seen that this arrangement of partial separation lends itself to automated testing.

Figure 8:
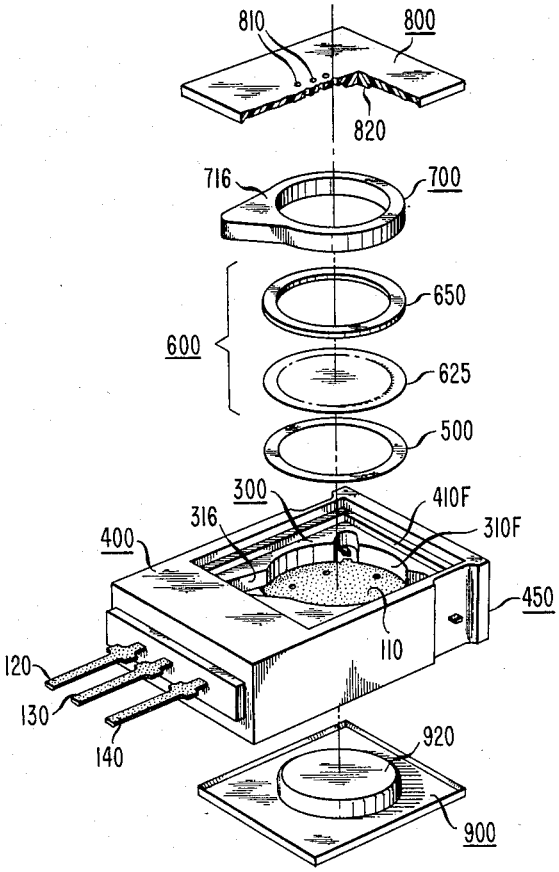
FIG. 8 is an exploded perspective view of the components comprising the transducer.
Figure 9:
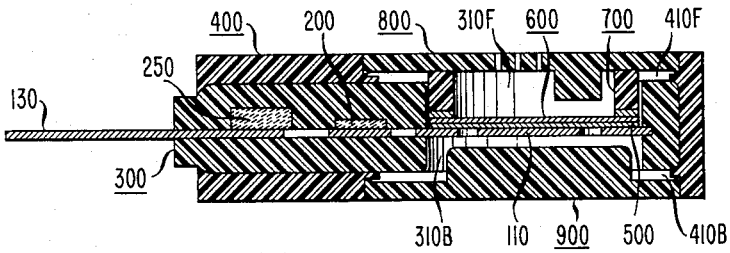
FIG. 9 is a sectional view of the assembled transducer taken along 9—9 of FIG. 1.

Referring now to FIGS. 1, 8 and 9, the next step in the assembly of the transducer, whether fully or partially separated from the strip 10, is the placement of a dielectric annular spacer 500 into the front opening 310F in the inner housing member 300, the spacer resting on the backplate 110. This is followed by the placement of a diaphragm assembly 600 within the front opening in engagement with the spacer 500. The diaphragm assembly 600 comprises a circular electret diaphragm 625 and a rigid electrically conductive annular support 650. The upper surface of the diaphragm 625 is metalized to provide an electrically conductive surface and the support 650 is bonded to this surface while the diaphragm is restrained under radial tension. Thus, the support 650 maintains the diaphragm 625 under tension.

The final component positioned within the front opening 310F of the inner housing 300 is an electrically conductive compressible gasket 700 which rests on the support 650. The gasket 700 is basically an annular member that is of the same configuration as the support 650, but it includes a tab portion 716 that generally conforms to the recess 316 in the opening 310 of the inner housing member 300. As described above, the connecting link 126 (FIG. 7) extends upwardly within the recess 316 and consequently is engaged by the tab portion 716 of the gasket 700. Thus, the conductive surface of the diaphragm 625 is electrically connected via the support 650, the gasket 700, and the connecting link 126 to the lead 120, this being the same lead to which the outer housing member 400 is electrically connected. The gasket 700 is advantageously formed from a conductive silicone rubber compound.

The assembly of the transducer is completed by the joining of an electrically conductive front cover 800 and an electrically conductive back cover 900 to the outer housing member 400. The perimeters of the front cover 800 and the back cover 900, respectively, conform to the perimeters of the front opening 410F and the back opening 410B in the outer housing member 400. The covers 800 and 900 are advantageously formed from basically the same polymer as the outer housing member 400 and are advantageously joined to the outer housing member by ultrasonic bonding.

The front cover 800 when joined to the outer housing member 400 compresses, and is thereby electrically connected to, the gasket 700. As a result, the gasket 700 electrically connects the conductive surface of the diaphragm 625 to the lead 120 both through the connecting link 126 (FIG. 7) and the outer housing member 400. In addition, the compressed gasket 700 provides a biasing force that ensures that the diaphragm assembly 600 is in direct engagement with the spacer 500 and the spacer is in direct engagement with the backplate 110. Controlled air gap spacing between the diaphragm 625 and the backplate 110 is thereby achieved.

The front cover 800 has a number of holes 810 extending through it that serve as acoustic filters providing electroacoustic frequency response shaping. These holes are advantageously very small to provide a large acoustic impedance, eliminating the need for the addition of a screen to perform this function. Holes of such size can be advantageously obtained by laser drilling.

Finally, the front cover 800 and the back cover 900, respectively, have protrusions 820 and 920 that extend into the openings 310F and 310B. The protrusions 820 and 920 provide a convenient way to adjust the front and back acoustic chamber volumes to yield a desired frequency response shape for a particular application.

The transducer can be modified to be noise cancelling by providing external openings that communicate with the back chamber. This can be accomplished by either providing holes in the back cover 900 or by providing additional holes in the front cover 800 that communicate with the recesses 314 and 315 (FIG. 7) in the opening 310 of the inner housing member 300.

The transducer can also be modified to use piezoelectric polymer rather than an electret for the diaphragm 625. In that arrangement, diaphragm 625 would be metalized on both its upper and lower surfaces, and the spacer 500 would be formed from a conductive rather than a dielectric material.

These and other modifications may be made by persons skilled in the art without departing from the spirit and scope of the invention.

What is claimed is:

1. An electroacoustic transducer comprising:

a unitary discrete electrically conductive member from which both a plurality of leads and a backplate are formed;

a diaphragm positioned adjacent to the backplate; and means for providing electrical interconnection between the backplate and at least one of the leads.

2. An electroacoustic transducer as in claim 1 wherein the electrical interconnection means comprises an integrated circuit and a connecting wire extending between the circuit and the backplate and between the circuit and at least one of the leads.

3. An electroacoustic transducer as in claim 2 wherein the integrated circuit is supported on one of the leads and a dielectric housing is molded about the perimeter of the backplate and the portion of the leads adjacent to the backplate, the dielectric housing encapsulating the integrated circuit and the connecting wires and including an opening on one side of the backplate within which the diaphragm is positioned.

4. An electroacoustic transducer as in claim 3 wherein capacitors are supported on and electrically connected to the leads, and the dielectric housing encapsulates the capacitors.

5. An electroacoustic transducer as in claim 1 further including a dielectric housing molded about the perimeter of the backplate and the portion of the leads adjacent to the backplate, the dielectric housing including an opening on one side of the backplate within which the diaphragm is positioned.

6. An electroacoustic transducer as in claim 3 wherein the dielectric housing is an inner housing member and an electrically conductive outer housing member is molded about the inner housing member and engages one of the leads.

7. An electroacoustic transducer as in claim 6 wherein the diaphragm comprises an electret, the surface of the diaphragm remote to the backplate is electrically conductive, the diaphragm is joined to an electrically conductive annular support member that maintains the diaphragm under tension, and an electrically conductive annular gasket engages the support member and provides an electrical connection to the same lead engaged by the outer housing member.

8. An electroacoustic transducer as in claim 7 further including an electrically conductive cover that is positioned over the opening in the inner housing member in engagement with the conductive gasket and joined to the outer housing member.

9. An electroacoustic transducer comprising:

a conductive member;

a dielectric housing molded about the perimeter of the conductive member, the housing including an opening on at least one side of the conductive member; and a diaphragm positioned within the opening adjacent to the conductive member.

10. An electroacoustic transducer as in claim 9 wherein the dielectric housing is an inner housing member and an electrically conductive outer housing member is molded about the inner housing member.

11. An electroacoustic transducer as in claim 10 further including an electrically conductive cover that is positioned over the opening in the inner housing member and joined to the outer housing member.

12. An electroacoustic transducer comprising:

a plurality of leads separated from one another;

a dielectric member molded about the leads;

an electrically conductive member supported by the dielectric member;

a diaphragm positioned adjacent to the conductive member; and a conductive housing molded about the dielectric member.

13. An electroacoustic transducer as in claim 12 wherein the conductive member is a backplate, the diaphragm has a conductive surface remote to the backplate, and the transducer further includes means for providing electrical continuity between the conductive surface of the diaphragm and the conductive housing.

14. An electroacoustic transducer as in claim 12 wherein the conductive housing includes an opening in registration with the conductive member and an electrically conductive closure member is positioned within the opening and joined to the housing.

15. An electret transducer comprising:

a rigid electrically conductive frame member;

a dielectric member molded about the frame member, the dielectric member including an opening on at least one side of the frame member;

a backplate supported within the opening; and an electret diaphragm positioned within the opening adjacent to the backplate.

16. An electret transducer as in claim 15 wherein the frame member includes a plurality of leads and the backplate.

17. An electret transducer as in claim 15 further including an electrically conductive housing molded about the dielectric member.

18. An electroacoustic transducer comprising:

an electrically conductive frame member;

a dielectric inner housing member molded about the frame member, the inner housing member including at least one acoustic chamber; and an electrically conductive outer housing member molded about the dielectric inner housing member.

19. An electroacoustic transducer comprising:

a unitary electrically conductive frame member from which both a plurality of leads and a backplate are formed;

a dielectric inner housing member molded about the perimeter of the backplate and the portions of the leads adjacent to the backplate, the inner housing member having an opening extending on each side of the backplate;

a conductive outer housing member molded about the inner housing member, the outer housing member engaging one of the leads and including openings in registration with the openings in the inner housing member;

an electret diaphragm positioned within the opening in the inner housing member on one side of the backplate, the diaphragm having a conductive surface remote to the backplate;

an annular rigid conductive support member joined to the conductive surface of the diaphragm, the support member maintaining the diaphragm under tension;

a compressible electrically conductive annular member positioned in engagement with the support member, the compressible member making electrical connection with the same lead engaged by the outer housing; and front and back electrically conductive cover members positioned within the openings of the outer housing member and joined to the outer housing member, the front cover member engaging the compressible member.

20. An electroacoustic transducer as in claim 19 wherein the cover member compresses the compressible member whereby the compressible member biases the support member and diaphragm into position with respect to the backplate.

21. An electroacoustic transducer as in claim 19 wherein joining of the cover members to the outer housing member provides front and back acoustic chambers, and the cover members have protrusions that extend into the respective chambers, the protrusions serving to adjust the front and back acoustic chamber volumes.

22. An electroacoustic transducer comprising:

a unitary discrete electrically conductive member from which both a plurality of leads and a backplate are formed;

a dielectric inner housing member molded about the perimeter of the backplate and the portion of the leads adjacent to the backplate, the inner housing member including an opening on one side of the backplate;

a diaphragm positioned within the opening in the inner housing member adjacent to the backplate; and an electrically conductive outer housing member molded about the inner housing member, the outer housing member engaging one of the leads.

23. An electroacoustic transducer as in claim 22 wherein the diaphragm comprises an electret, the surface of the diaphragm remote to the backplate is electrically conductive, the diaphragm is joined to an electrically conductive annular support member that maintains the diaphragm under tension, and an electrically conductive annular gasket engages the support member and provides an electrical connection to the same lead engaged by the outer housing member.

24. An electroacoustic transducer as in claim 23 further including an electrically conductive cover that is positioned over the opening in the inner housing member in engagement with the conductive gasket and joined to the outer housing member.

25. An electroacoustic transducer comprising:

a conductive member;

a dielectric inner housing member molded about the perimeter of the conductive member, the inner housing member including an opening on at least one side of the conductive member;

an electrically conductive outer housing member molded about the inner housing member; and a diaphragm positioned within the opening adjacent to the conductive member, the diaphragm comprising a piezoelectric polymer that has a conductive surface both adjacent to and remote to the conductive member, the conductive surface adjacent to the conductive member being in electrical continuity with the conductive member, and the conductive surface remote to the conductive member being in electrical conductivity with the outer housing member.

26. An electroacoustic transducer comprising:

a plurality of leads separated from one another;

a dielectric member molded about the leads;

an electrically conductive backplate supported by the dielectric member;

a diaphragm positioned adjacent to the backplate, the diaphragm having a conductive surface remote to the backplate;

a conductive housing molding about the dielectric member; and means for providing electrical continuity between the conductive surface of the diaphragm and the conductive housing, the continuity means including a rigid electrically conductive member in engagement with the conductive surface of the diaphragm and a compressible electrically conductive member in engagement with the rigid member.

27. An electroacoustic transducer comprising:

a plurality of leads separated from one another;

a dielectric member molded about the leads;

an electrically conductive member supported by the dielectric member;

a diaphragm positioned adjacent to the conductive member; and a conductive housing molded about the dielectric member, the conductive housing engaging one of the leads.

* * * * *